United States Patent [19]

Thomas et al.

[11] 3,965,791

[45] June 29, 1976

[54] STOP TABLET ASSEMBLY

[75] Inventors: Howard M. Thomas, North Tonawanda; Richard A. Borowiec, Grand Island, both of N.Y.

[73] Assignee: The Wurlitzer Company, Chicago, Ill.

[22] Filed: June 19, 1974

[21] Appl. No.: 481,114

[52] U.S. Cl. ..... 84/343; 84/1.01; 200/6 R; 200/339

[51] Int. Cl.[2] ..... G10B 3/10; G10H 1/00

[58] Field of Search ..... 84/1.01, 331–334, 84/341, 343, 423, 433–436, DIG. 7, 344, 345; 200/1 R, 5 R, 5 A, 6 R, 293, 339

[56] References Cited

UNITED STATES PATENTS

| | | | |
|---|---|---|---|
| 2,816,181 | 12/1957 | Mann et al. | 84/1.01 UX |
| 3,246,087 | 4/1966 | Haviland | 200/5 R X |
| 3,342,967 | 9/1967 | Brand et al. | 200/339 X |
| 3,403,236 | 9/1968 | Zoludow | 200/339 X |
| 3,576,958 | 5/1971 | Ohno | 84/1.01 X |
| 3,580,979 | 5/1971 | Amano | 84/DIG. 7 |
| 3,617,600 | 11/1971 | Ohno | 84/DIG. 7 |
| 3,705,254 | 12/1972 | Amano | 84/DIG. 7 |
| 3,708,605 | 1/1973 | Ohno | 84/DIG. 7 |
| 3,745,874 | 7/1973 | Martin et al. | 84/433 |
| 3,746,820 | 7/1973 | Holder, Jr. | 84/423 X |
| R23,956 | 3/1955 | Jewett | 84/423 X |

*Primary Examiner*—L. T. Hix
*Assistant Examiner*—Stanley J. Witkowski
*Attorney, Agent, or Firm*—Olson, Trexler, Wolters, Bushnell & Fosse, Ltd.

[57] ABSTRACT

A molded plastic mounting base is provided for stop tablets on an organ or the like. Pivot shoulders are integrally molded on the mounting plate. Each stop tablet has complementary pivot recesses integrally molded therein. A single blade-type spring snapped on to depending structure on each stop tablet simultaneously operates as a retaining means for a respective stop tablet and as an overcenter biasing spring therefor.

12 Claims, 8 Drawing Figures

FIG.3
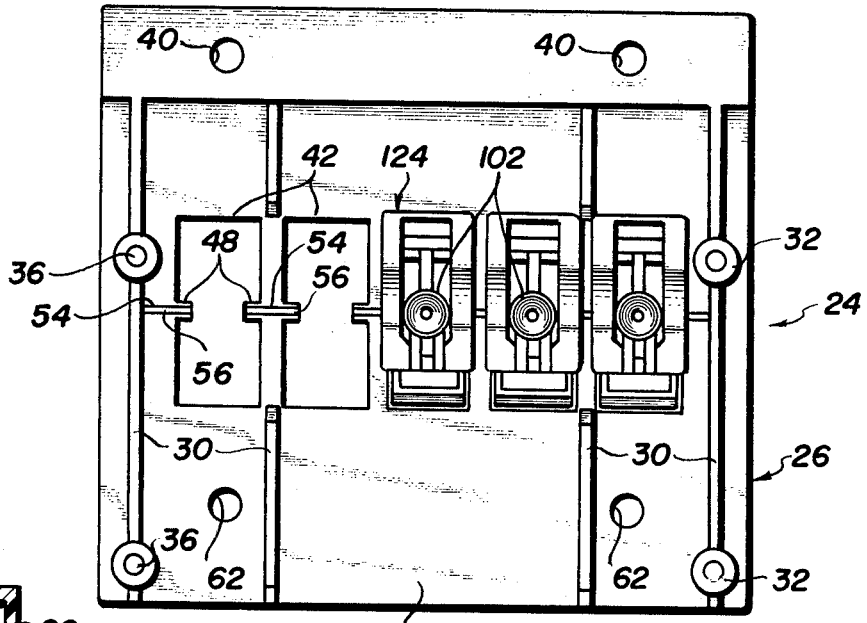
FIG.5
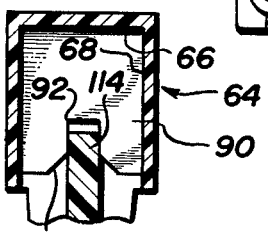
FIG.4
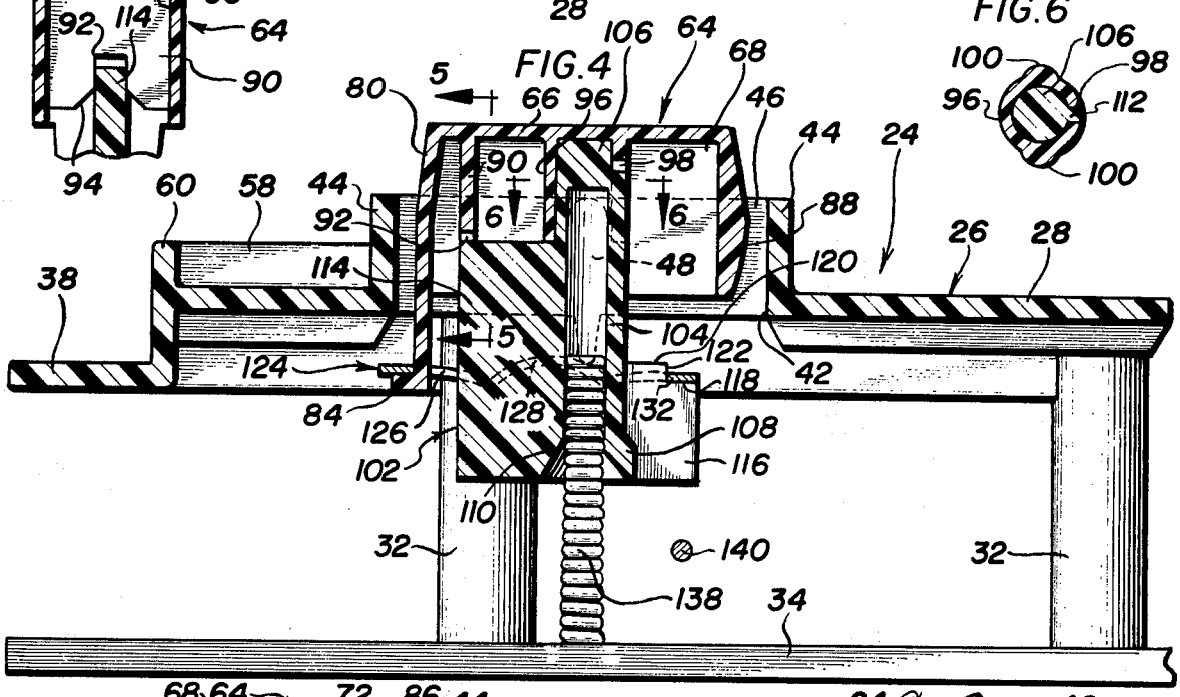
FIG.6
FIG.7
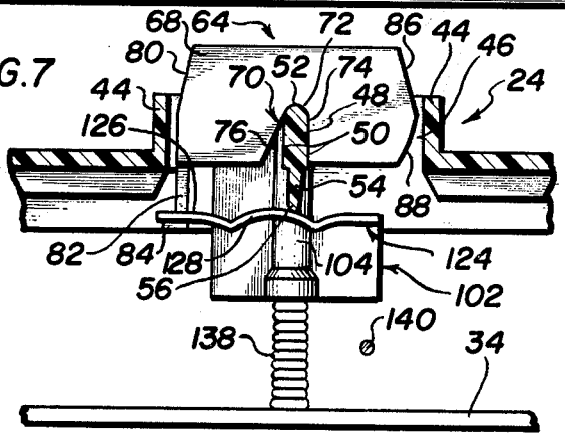
FIG.8
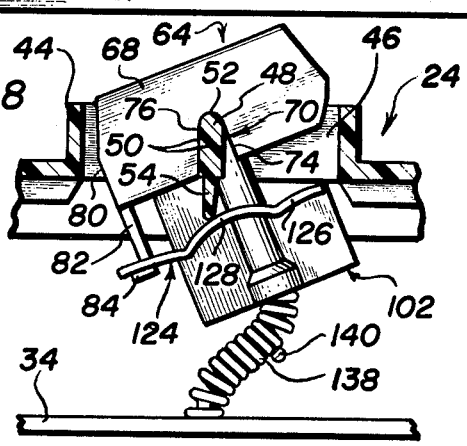

STOP TABLET ASSEMBLY

BACKGROUND OF THE INVENTION

Electronic organs have been manufactured and sold for many years. It is common practice to provide a plurality of stop tablets on such organs which, upon individual actuation, determine the organ footages or voices that are to play in response to manipulation of the keys and pedals of the organ. Such stop tablets commonly rock between one of two positions, namely on and off. It is common practice to provide a pivot pin in the mounting structure and through one or more stop tablets, and to provide various spring biasing means of an overcentering nature to cause a stop tablet to remain in either the on or off position to which it is rocked. Prior art practices have required a great deal of hand labor in the assembling of parts of stop tablet assemblies, and hand labor becomes progressively more expensive each year.

OBJECTS AND BRIEF DESCRIPTION OF THE INVENTION

It is an object of the present invention to provide a stop tablet assembly having a minimum of parts.

It is further an object of the present invention to provide a stop tablet assembly having a minimum number of parts to be assembled by the use of hand labor.

The foregoing and other objects of the present invention are attained by the use of molded plastic stop tablets having pivot notches integrally molded therein and receiving shoulders integrally molded with a mounting plate. Each stop tablet is held in assembled position by a leaf-type spring which acts as an overcenter spring as well as a retaining member.

DRAWING DESCRIPTION

FIG. 3 is a somewhat further enlarged view taken from beneath FIG. 2;

FIG. 4 is a further enlarged cross-sectional view taken substantially along the line 4—4 in FIG. 2;

FIG. 5 is a sectional view taken substantially along the line 5—5 in FIG. 4;

FIG. 6 is a horizontal cross-sectional view taken along the line 6—6 in FIG. 4;

FIG. 7 is a view on a slightly decreased scale generally similar to the central portion of FIG. 4 but showing parts in solid lines; and FIG. 8 is a fragmentary view similar to FIG. 7 showing the parts in a different position of operation.

DETAILED DESCRIPTION OF THE ILLUSTRATED EMBODIMENT

Figure 1:
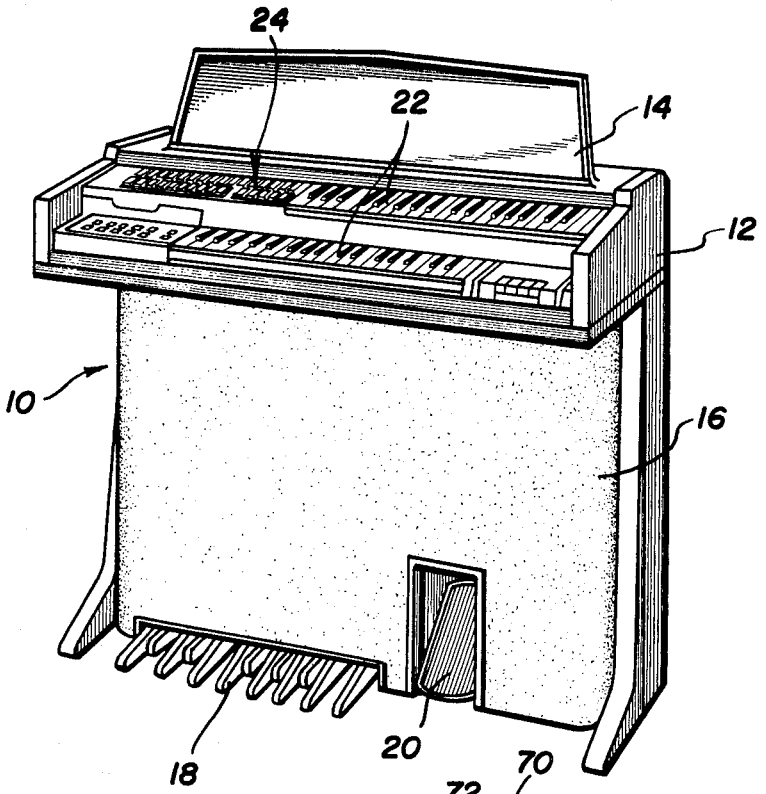
FIG. 1 is a perspective view of an organ having a stop tablet assembly constructed in accordance with the present invention.
Figure 2:
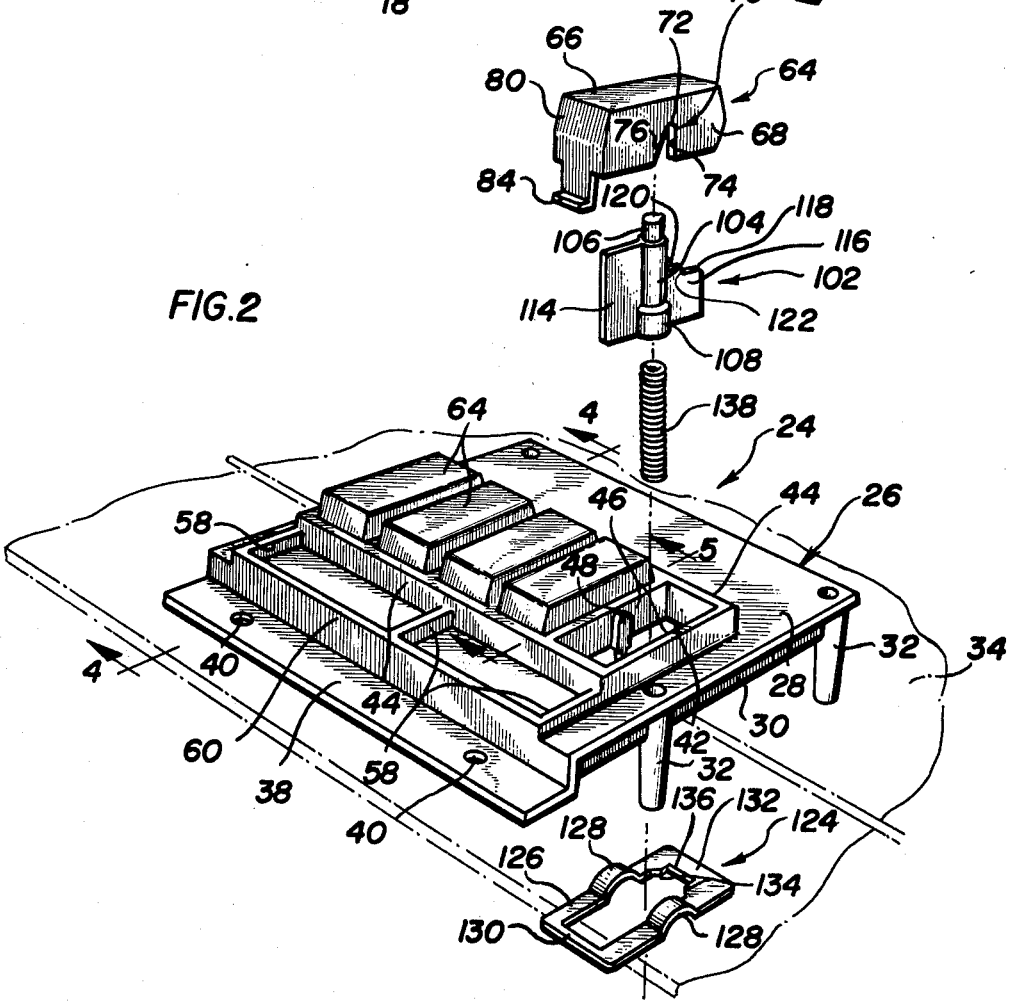
FIG. 2 is a partially exploded perspective view on an enlarged scale showing the stop tablet assembly of the present invention.

An organ embodying the principles of the present invention is shown at 10 in FIG. 1, including a case 12 of any suitable design and construction. The organ case includes a music rack 14, and a front panel 16 carrying one or more loud speakers behind the usual grille cloth. The organ is provided with the usual pedal clavier 18 having 13 foot pedals (one octave plus one of semitones) to be played by the left foot. A swell pedal 20 is provided for operation by the right foot. The organ also includes a pair of keyboards 22 arranged in the usual spinnet configuration with the keyboards overlapping by perhaps an octave.

The foregoing parts may present novelty in and of themselves, or may be constructed in accordance with concepts well known in the art. In addition to the parts heretofore enumerated the organ is provided with one or more sets of stop tablet assemblies 24 each having a plurality of stop tablets and forming the subject matter of the present invention.

The stop tablet assembly of the present invention will be best understood with reference to the remaining figures of the drawings. The stop tablet assembly 24 comprises a base 26 comprising a generally flat plate 28 having reinforcing ribs 30 on the underside thereof. Mounting posts 32 extend down from the plate 28 for engagement with an underlying supported structure 34. The posts are hollow as indicated at 36 in FIG. 3 for receipt of screws passing up through the supported structure 34. Additional attaching mounting means comprises a dropped flange 38 at the front of the plate 28 having screw receiving apertures 40 therein.

The plate 28 has a plurality (five in the illustrated embodiment) of apertures 42 in side-by-side relation. The apertures are rectangular in nature and there are two common end walls 44 passing all of the apertures. Side walls 46 upstand from the apertures 42. Each side wall is provided with an inward protuberance 48, the shape of which is best seen in FIGS. 7 and 8. Each such protuberance 48 is vertically elongated and includes flat side walls 50 and a rounded upper shoulder 52 forming a pivot support for a stop tablet as will be brought out hereinafter. Each protuberance 48 below the side wall 46 on which it is formed depends as a wedge-like projection 54 having a rounded lower end 56. As best may be seen in FIG. 3 the depending wedges 54 of back-to-back projections 48 span the underside of the respective wall 46 and are joined integrally together. The two end depending wedges 54 extend beneath the plate 28 so as to be substantially as long as back-to-back wedges.

The base 26 is completed by additional short reinforcing ribs 58 extending forwardly from the front common end wall 44 and spanned by an elongated upstanding rib 60. Additional mounting holes 62 (FIG. 3) are provided near the back of the plate 26.

Each of the apertures 42 have a stop tablet 64 pivotally mounted therein. Each stop tablet, like the base 26, is molded of a suitable plastic. Two suitable examples comprise styrene and ABS. Each stop tablet (see particularly FIGS. 2, 4, 5, 7 and 8) is of generally box-like configuration, including a top flat wall 66. A pair of side walls 68 depends substantially straight down from the top wall 66 of each stop tablet. Each such side wall is provided with a downwardly opening, generally V-shaped notch 70. Each such V-shaped notch has a rounded apex 72 received on the corresponding projection shoulder 52 as a pivotal support. The rear edge 74 of each V-shaped notch 70 extends straight down and forms a limit stop for pivotal movement of the stop tablet 64 in a clockwise direction as viewed in FIGS. 7 and 8, this being the off position. On the other hand, the forward edge 76 extends diagonally or divergingly downward and forms a limit stop engageable with the flat side wall 50 of the projection 48 for the stop tablet in a counterclockwise or on position as shown in FIG. 8.

The stop tablet further includes a front wall 80 having an upwardly tapered portion and a lower straight down portion. The lower portion provides for close approach to the front wall 44 in the off position shown in FIG. 7, while the upper tapered portion provides for such a close approach in the tipped or on position of FIG. 8. The lower portion of the front wall 80 depends straight down as a flange 82 having a forwardly projecting foot 84, the purpose of which will be discussed hereinafter.

Each stop tablet 64 further has a rear end wall having a downwardly and outwardly tapered upper portion 86, and an inwardly tapered or oblique lower portion 88, again to provide for a close approach but with sufficient clearance to the rear upstanding wall 44.

Each stop tablet 66 has internally thereof (see particularly FIGS. 4 and 5) a transverse wall 90 relatively toward the front thereof. This wall has a downwardly opening notch 92 therein with a beveled entrance 94.

Each stop tablet further has internally thereof a downwardly opening hollow boss 96 (FIGS. 4 and 6) having a downwardly opening notch 98 directed rearwardly of the stop tablet. Reinforcing ribs 100 are provided on the boss oppositely of one another and at 90° to the notch 98.

A depending switch operator 102 is secured to the underside of each stop tablet and comprises a central post portion 104 having an upstanding stud 106 of somewhat reduced diameter at the upper end and an outwardly flared lower end 108 with a beveled counterbore 110 opening downwardly thereform. The upstanding stud 106 is received in the hollow boss 96 and has a rib 112 received in the slot 98 to key the parts together. The parts are welded together either sonically or by a suitable solvent.

The depending switch operator 102 further includes a wing or wall 114 lying in a diametral plane of the post 104 and extending forwardly therefrom. This wall braces and stabilizes the post 104 and the upper outer edge portion thereof is received in the slot 92 to position and stabilize the switch operator. The switch operator further is provided with a rearwardly extending wall 116, which in practice is bifurcated for improved molding and curing of the plastic material, which again is a styrene or ABS material. This wall is provided with a shelf 118 adjacent the upper edge thereof and substantially on a level with the flange or foot 84. An upward step 120 above the shelf 118 provides a shoulder 122.

Each stop tablet further is provided with a retaining and biasing spring 124. This is a blade-type spring, and in its normal unstressed condition has a pair of substantially straight, parallel side members 126, each having slightly off center of its midpoint an arcuate raised section 128. The side members 126 are interconnected at their forward ends by an integral transverse member 130. The side members also are connected at their rear ends by an integral transverse member 132. Internal shoulders 134 between the side members 126 and the rear end member 132 provide a restricted opening portion or neck 136.

In order to assemble a stop tablet 64 with the base 24 the stop tablet is simply inserted from above into its respective aperture 42, the rounded apices 72 of the notches in the side walls resting on the rounded upper ends 52 of the projections 42, being pivoted thereon. A respective spring 124 then is placed over the switch operator so that the rear transverse spring member 132 is above the shoulder 122, resting on a ledge 120 of the bifurcated wall 116. The opposite transverse end 130 of the spring then is flexed up to a position above the shelf 84. The relative positioning of the lower rounded end 56 of the depending wedges 54, of the surface 120, and of the flange 84, cooperating with the raised portions 128 of the spring require such flexing to raise the transverse end 130 above the flange 84. The spring is then pressed rearwardly so that the transverse rear member 132 snaps down over the shoulder 122 and rests on the ledge 118. The necked or restrictive portion 136 is of proper width to embrace the bifurcated wall 116 in the vicinity of the shoulder 122. Similarly, the spacing between the side members 126 is such as to embrace the edges of the depending member 82. The parts now are in the positions in FIGS. 4 and 7 with the rounded lower edge 56 of each wedge-shaped depending projection 54 exerting a slight downward pressure on the right portion of the raised portions 128 of the spring side members. Thus, each stop tablet is held in position with the rounded apices 72 resting on the rounded upper edges 52 of the projections 48. The right or rear edge 74 of each notch bears against the vertical rear surface 50 of each projection as a limit stop. When the front end of a stop tablet is depressed the rounded lower edge 56 of each depending wedge-shaped projection 54 snaps over the top of the corresponding raised spring portion 128, serving as a toggle, to insure movement of the stop tablet fully to the position shown in FIG. 8 with the notch front wall 78 serving as a limit stop against the corresponding flat front wall of the respective projection 48.

The underlying member 34 is supported by the posts 32 and comprises a printed circuit board or card. A plurality of helical springs 138 are soldered to and extend up from the upper surface of the printed circuit board 34 for respective receipt in the beveled counter bores 110 in the bottoms of the switch operators 102. When a stop tablet is tipped from the off position of FIG. 7 to the on position of FIG. 8 the helical spring associated therewith is deflected from the straight up position to a tipped or deformed position wherein it contacts a bus bar 140, whereby to complete connection between the appropriate printed circuit wiring on the printed circuit board 34 and the bus bar 140. The bus bar is supported by insulating support means, and there may be a common bus bar for all of the stop tablets, or there may be a separate bus bar for each stop tablet depending on the type of circuit controlled by the stop tablet. In the latter case, the bus bar 140 might well comprise the bight of a U-shaped wire upstanding from the printed circuit board 34.

It will now be apparent that we have provided a stop tablet assembly with a minimum of parts and with a minimum of hand labor required for construction and assembly. The pivots are molded integrally into the base 24 and each stop tablet 64, thus completely eliminating manual handling of pivots. Switch contacts are presented by means of the printed circuit board 34, and each stop tablet is held or retained in place by the respective spring 124 which simultaneously serves as a resilient retainer and as a biasing spring to produce a toggle action to each stop tablet as it is pivoted between the on and off positions. A blade spring of the type disclosed is readily fabricated from sheet steel in automatic punch press machinery, whereby the cost of such a spring is minimal. Insertion of each stop tablet in its respective position can be done by automatic machinery, or by hand. The only additional hand operation needed is the insertion of the respective spring 124.

The specific example of the invention as herein shown and described is for illustrative purposes only. Various changes in structure will no doubt occur to those skilled in the art, and will be understood as forming a part of the present invention insofar as they fall within the spirit and scope of the appended claims.

The invention is claimed as follows:

1. In an electronic musical instrument, the combination comprising a stop tablet assembly including a base, means on said base for receiving a stop tablet and including pivotal mounting means, a stop tablet, pivot means on said stop tablet cooperable with said pivotal mounting means rockably to mount said stop tablet on said base, and spring means acting between said base and said stop tablet and engaging said stop tablet below said pivot means to simultaneously bias said stop tablet pivot means against said pivotal mounting means, secure said stop tablet to said base, and provide an overcentering action to rocking of said stop tablet.

2. The combination set forth in claim 1 wherein one of said pivotal mounting means and said pivot means comprises a convex surface and the other comprises a concave surface, and said spring means urge said surfaces together.

3. The combination set forth in claim 2 wherein said convex surface comprises a rounded shoulder and said concave surface comprises a recess having a rounded end.

4. The combination as set forth in claim 1 wherein said spring means comprises a blade spring trapped on one of said base and said stop tablet and bearing against a complementary part of the other thereof.

5. The combination as set forth in claim 2 wherein said spring means commprises a blade spring trapped on one of said base and said stop tablet and gearing against the complementary part of the other thereof.

6. The combination as set forth in claim 3 wherein said spring means comprises a blade spring trapped on one of said base and said stop tablet and bearing against the complementary part of the other thereof.

7. The combination as set forth in claim 4 wherein said blade spring has an intermediate deformation therein projecting toward the part against which it bears to produce overcentering.

8. The combination as set forth in claim 1 wherein the means on said base for receiving a stop tablet comprises an aperture therein, said pivotal mounting means comprising shoulders projecting into said recess opposite to one another, said pivot means comprising downwardly opening recess means in said stop tablet fitting over said shoulder means, said spring means biasing said stop tablet down resiliently to retain said recess means on said shoulder means.

9. The combination set forth in claim 8 wherein said recess means have diverging edges and wherein said shoulder means have depending side portions coacting with said edges as limit stops to rocking of said stop tablet.

10. The combination set forth in claim 9 wherein said stop tablet has depending projecting means thereon with fore and aft shoulder thereon, said spring means comprising a blade spring having an aperture therein received over said shoulders, and projecting means on said base engaging said blade spring.

11. In an electronic musical instrument, the combination comprising a stop tablet assembly including molded plastic base means having an aperture therein for receipt of a rockable stop tablet, a pair of integral molded aligned projections in said aperture and having rounded upper shoulder means forming pivot means, a stop tablet received in said aperture and having downwardly directed recess means on said shoulder means, and an overcentering spring acting between said stop tablet and said base means and engaging said stop tablet below said pivot means for securing said stop tablet to said base and resiliently biasing said recess means down against said shoulder means.

12. The combination as set forth in claim 11 wherein said projections includes the side walls depending from said shoulder means, and wherein said recess means have diverging edges respectively engageable with said side walls to limit rocking of said stop tablet in either direction.

* * * * *